US006708610B2

(12) United States Patent
Yamanouchi et al.

(10) Patent No.: US 6,708,610 B2
(45) Date of Patent: Mar. 23, 2004

(54) BOLSTER-ELEVATING DEVICE FOR A PRESS

(75) Inventors: Akira Yamanouchi, Sagamihara (JP); Noriyuki Shimizu, Kanagawa (JP); Naonori Taniguchi, Kanagawa (JP)

(73) Assignee: Aida Engineering Co., Ltd., Kanagawa (JP)

( * ) Notice: Subject to any disclaimer, the term of this patent is extended or adjusted under 35 U.S.C. 154(b) by 0 days.

(21) Appl. No.: 10/179,036

(22) Filed: Jun. 24, 2002

(65) Prior Publication Data

US 2003/0051612 A1 Mar. 20, 2003

(30) Foreign Application Priority Data

Sep. 18, 2001 (JP) ..... 2001-283307

(51) Int. Cl.[7] ..... B30B 1/00

(52) U.S. Cl. ..... 100/918; 100/214; 100/257; 72/448; 83/563

(58) Field of Search ..... 100/918, 214, 100/219, 229 R, 240, 245, 258 R, 269.01, 257, 269.17; 72/352, 361, 446, 448, 462, 466.7, 481.1, 481.2, 481.3, 481.4, 481.5, 481.6, 481.7; 83/527, 530, 563

(56) References Cited

U.S. PATENT DOCUMENTS

| | | | | |
|---|---|---|---|---|
| 3,225,686 A | * | 12/1965 | Clements | 100/43 |
| 4,206,699 A | * | 6/1980 | Hemmelgarn | 100/346 |
| 5,102,278 A | * | 4/1992 | Herdzina, Jr. | 413/66 |
| 5,218,901 A | * | 6/1993 | Imanishi | 100/353 |
| 6,128,987 A | * | 10/2000 | Nakagawa et al. | 83/76.9 |
| 6,267,050 B1 | | 7/2001 | Brewer | 100/257 |

FOREIGN PATENT DOCUMENTS

JP 08-112699 5/1996

* cited by examiner

*Primary Examiner*—Allen Ostrager
*Assistant Examiner*—Shelley Self
(74) *Attorney, Agent, or Firm*—Darby & Darby

(57) ABSTRACT

Guide posts that guide the elevating motion of a slide also serves as the guide means for the elevating motion of a bolster. A bolster elevation drive means consists of a hydraulic cylinder. The top of the hydraulic cylinder is connected to the bottom of the bolster. For maintenance and inspection of the dies, the bolster is lowered to open a space between the upper die and the lower die. During operation of the press, the bolster is supported by hydraulic pressure trapped in the hydraulic cylinder.

7 Claims, 2 Drawing Sheets

BOLSTER-ELEVATING DEVICE FOR A PRESS

BACKGROUND OF THE INVENTION

1. Field of the Invention

The present invention relates to a quick die opening technology for facilitating die maintenance or inspection for a press. The technology operates the slide at high speeds and for a slide stroke in the range of from a few millimeters to a slightly more than 10 millimeters.

2. Description of the Related Art

Of various presses used in the industry today, high-speed automatic presses used for stamping, e.g., IC reed frames and connectors, typically operate at a speed (the number of slide strokes) of 1,000 spm or higher, with a slide stroke ranging in a few millimeters to a slightly more than 10 millimeters. The distance between the upper and lower dies (i.e., opening of such a press) is therefore less than 100 millimeters even if the slide is adjusted to its upper limit position with the help of a die height adjustment mechanism. It takes time to move the slide to its upper limit position with the help of the die height adjustment mechanism. When the slide is returned to its original position after the inspection, it is extremely difficult to restore the original slide position, which was established by fine adjustments prior to the inspection. Consequently, die maintenance or inspection procedures have always been difficult and time-consuming. In order to solve this problem, various quick die opening mechanisms have been proposed, wherein die maintenance can be done without removing the dies from the press. For example, Japanese Laid-open Patent Publication H8-112699 discloses a slide device comprising a hydraulic cylinder mechanism between the slide and the small end of the connecting rod, which is connected to the crankshaft. The connecting rod constitutes the piston of the hydraulic cylinder mechanism. A threaded area is formed on the periphery of the cylinder. The threaded area and a worm mechanism together constitute a die height adjustment mechanism. This slide device controls the opening between the upper and lower dies by raising and lowering the slide with the stroke of the hydraulic cylinder.

The problem with the mechanism proposed by the Japanese Laid-open Patent Publication H8-112699 is that the hydraulic cylinder on the slide side increases the slide weight and hence the inertia force generated in the slide vertical strokes. On a high-speed automatic press, wherein the number of slide strokes exceeds 1,000 spm, it is mandatory to reduce the slide weight as much as possible in order to reduce the inertia force of the slide vertical strokes at high speeds. Therefore, it is disadvantageous for a press to be equipped with the mechanism disclosed by the Japanese Laid-open Patent Publication H8-112699 from the standpoint of making the machine to operate at higher speeds. Moreover, it is difficult and hence costly to machine the small end of the connecting rod into a piston-like shape so that it can slide inside the cylinder as well as to machine the inside of the threaded member of the die height adjustment mechanism into a cylinder-like shape, while both which are required in the mechanism disclosed by the Japanese Laid-open Patent Publication H8-112699.

OBJECTS AND SUMMARY OF THE INVENTION

An object of the present invention is to provide a bolster-elevating device that is capable of quickly opening the dies and is suitable for high-speed automatic presses.

According to an embodiment of the present invention, there is provided a bolster-elevating device for a press, which is equipped with a set of dies consisting of an upper die and a lower die, the upper die being affixed to the bottom surface of a slide while the lower die being affixed to the top surface of a bolster, and conducts stamping operations by means of vertical strokes of the slide, wherein the bolster is formed in such a way as to be able to be elevated (raised or lowered) arbitrarily, guide means that guides the vertical strokes of the slide is common with the guide means that guides the elevation (raising and lowering) of the bolster, bolster-elevating drive means that drives the elevating motion of the bolster is provided under the bolster, and the stroke of the bolster-elevating drive means is sufficiently large for providing a wide-enough opening between the upper die from the lower die wide for performing maintenance or inspection of the dies.

One feature of the embodiment is that the guide means for the bolster shares the same element as the guide means for the slide vertical strokes. In other words, the bolster-elevating motions and the slide vertical strokes share the same guide means. Another feature is that the bolster-elevating drive means is provided under the bolster of the press. Another feature is that the stroke (amount of elevation) of the bolster is sufficiently large to provide a wide-enough opening between the upper die from the lower die wide for performing maintenance or inspection of the dies.

According to the bolster-elevating device of such a constitution, there is no need for providing a quick die opening function that provides a wide-enough opening between the upper die from the lower die wide for performing maintenance or inspection of the dies on the slide side. In the prior art mechanism, however, an additional mechanism (hydraulic cylinder, etc.) is used for elevating the slide for securing a specified distance between the upper and lower dies in addition to a conventional drive mechanism (drive mechanism including the crankshaft) for the vertical strokes of the slide, wherein the additional mechanism (hydraulic cylinder, etc.) is provided on the slide side. This causes an increase in the slide weight as well as the inertia force in the slide vertical strokes, consequently causing a hindrance to faster operations of the press. According to the present invention, there is no need to have a mechanism on the slide side for providing the quick die opening function, thus facilitating high-speed operation of the press.

Moreover, since the guide means is shared between the bolster elevation and the slide strokes, the horizontal positioning relation between the slide and the bolster is accurately maintained before and after the die opening for the purpose of die maintenance or inspection. In other words, no misalignment is caused after the die opening for the purpose of die maintenance or inspection, so that there is no need for adjusting the positions of the upper and lower dies again after die maintenance or inspection operations.

According to a second embodiment of the present invention, there is provided a bolster-elevating device for a press according to the first embodiment of the present invention wherein the guide means comprises: pin members extending downward from the bottom surface of the slide and guide members provided on the top surface of the bolster in correspondence with the pin member.

In the second embodiment, the pin members extending downward from the bottom surface of the slide fit guide members on the top surface of the bolster to constitute so-called guideposts, i.e., guide means. Therefore, in addition to the advantage provided by the first embodiment, the second embodiment provides another advantage in preventing misalignment between the upper and the lower dies after die maintenance or inspection operations using a simple structure without recourse to any special guide means.

According to a third embodiment of the present invention, there is provided a bolster-elevating device for a press according to the first or second embodiment of the present invention wherein the bolster-elevating drive means comprises a single or multiple hydraulic cylinder devices.

In the third embodiment, the bolster-elevating device consists of the hydraulic cylinder device(s) so that the press load is borne by hydraulic pressure. In contrast to the third embodiment of the present invention where the press load is borne by hydraulic pressure, the conventional bolster-elevating means, consisting of an electric motor and a rack and pinion mechanism, requires the press load to be borne by the mechanical structural components such as the motor and the rack and pinion mechanism. This makes it necessary for each member to be made larger and sturdier than in the case of the third embodiment of the present invention. Moreover, the constitution of a mechanical structure is generally more complex. Therefore, in addition to the features provided by the first and the second embodiment, the third embodiment provides another advantage of providing a bolster-elevating device of a more simplified and compact structure.

According to a fourth embodiment of the present invention, there is provided a bolster-elevating device for a press according to the third embodiment of the present invention wherein the hydraulic cylinder device comprises: an abutment member on the distal end of a rod affixed to the piston of the hydraulic cylinder device in order to limit the upper limit position of the piston by means of the abutment member.

In the fourth embodiment of the present invention, an abutment member is provided on the distal end of the rod affixed to the piston. This abutment limits the upper limit position of the piston. The conventional die height adjustment device, consisting of a worm mechanism, requires a time-consuming adjustment of the slide position, which consists of turning the worm shaft minutely manually or remotely by a motor controlled by an experienced worker, in order to adjust the slide position after die maintenance or inspection. On the contrary, according to the fourth embodiment of the present invention, the upper limit position of the piston of the hydraulic cylinder device, i.e., the upper limit position of the bolster is controlled by the abutment member. In other words, the bolster position is determined by the position of the abutment member, so that the upper limit position of the bolster does not vary before and after the maintenance or inspection. Therefore, in addition to the advantage according to the third embodiment of the present invention, the fourth embodiment of the present invention provides another advantage of maintaining the parallelism between the slide and the bolster more accurately after the maintenance or inspection as well as setting up the bolster position more efficiently after the maintenance or inspection.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
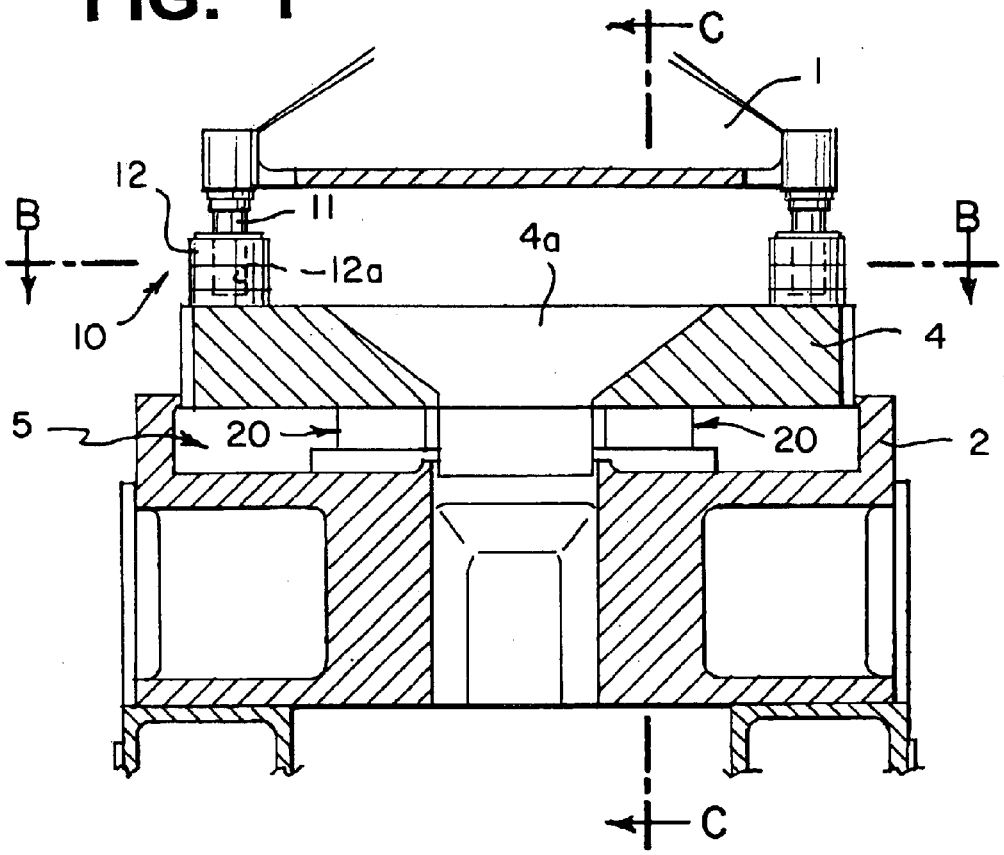
FIG. 1 is a cross-section view taken along the line A—A on FIG. 2, showing a front view of key components of a press according to an embodiment of the present invention.
Figure 2:
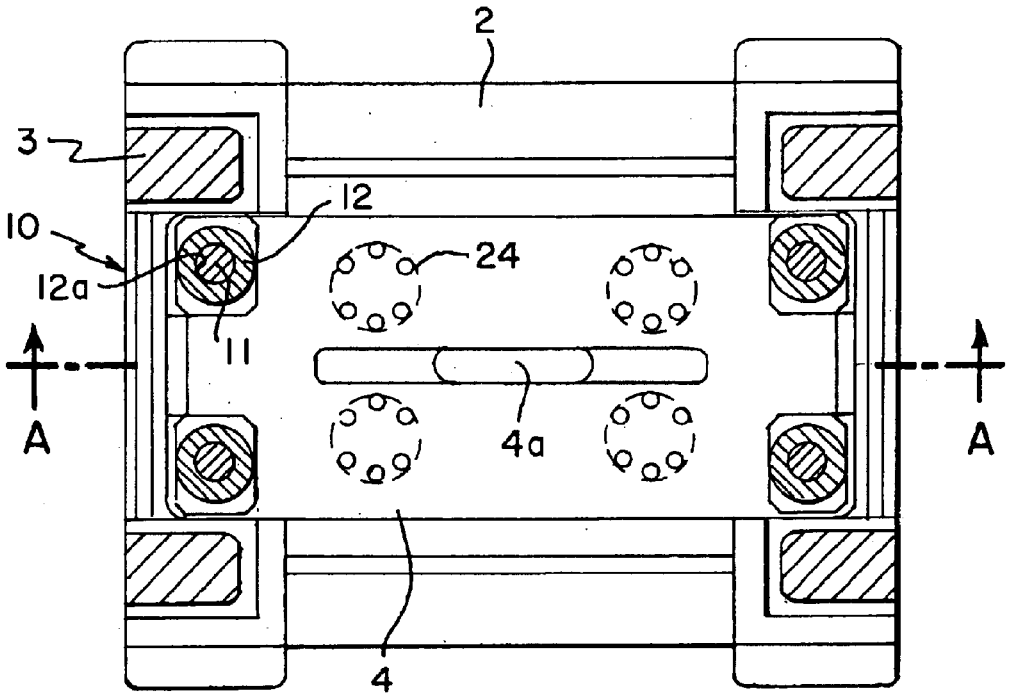
FIG. 2 is a cross-section view taken along the line B—B on FIG. 1, showing a top view of key components of a press according to an embodiment of the present invention.
Figure 3:
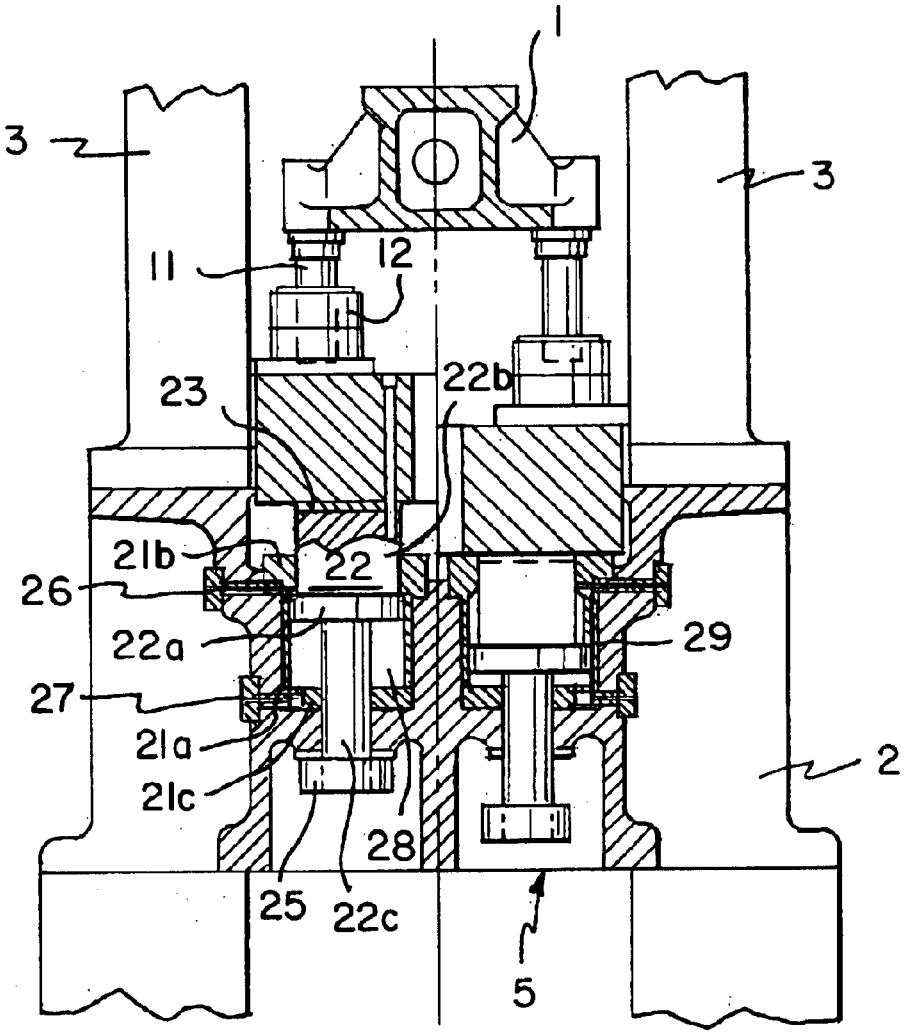
FIG. 3 is a cross-section view taken along the line C—C on FIG. 2, showing a side view of key components of a press according to an embodiment of the present invention.

Referring to FIGS. 1 through 3, key components of a press according to the preferred embodiments of the present invention are shown. Components of conventional presses are omitted for clarity of illustration and description.

A press generally includes a bed 2 located on its lower portion. A crown is supported on its upper portion above the bed on four columns 3. The crown, the column 3, and the bed 2 are connected by tie rods bolts. A connecting rod connects a slide 1 to a drive mechanism inside the crown. The slide 1 is free to move up and down in vertical strokes driven by a drive mechanism. The rotating kinetic energy of the flywheel, which is rotatively driven by the main motor, is applied to the drive mechanism via a clutch/brake mechanism and is transmitted to the connecting rod after being converted into a vertical reciprocating motion by the drive mechanism crankshaft, etc.

A bolster 4 is disposed on top of the bed 2. A conventional die consists of an upper die and a lower die. The lower die is affixed on the top of bolster 4. The upper die is affixed to the bottom of the slide 1. A drop hole 4*a* in the middle of bolster 4 permits the discharge of scraps generated during press operations.

The slide 1 is guided by guideposts 10 disposed at four corners of the slide 1 to permit free up and down motion. Each guidepost 10 includes a pin member 11 and a guide member 12. Each pin member 11 extends downward from its bottom corner of slide 1. Each guide member 12 extends up from the top of bolster 4 in correspondence with its pin member 11. Each guide member 12 includes a guide hole 12*a*. Each pin member 11 is inserted into its corresponding guide hole 12*a* to be guided thereby. Thus, slide 1 is guided to move freely up and down by guideposts 10 pin members 11 and guide members 12. From the viewpoint of bolster 4, bolster 4 is also guided by guideposts 10 pin members 11 and guide members 12 to move freely up and down. That is, guideposts 10 are common guide means for both the slide 1 and the bolster 4.

A bolster-elevating means 5 is disposed on the bottom of bolster 4 inside bed 2. Bolster-elevating means 5 includes four sets of hydraulic cylinder mechanisms 20. Each cylinder mechanism 20 has a cylinder 21 affixed to bed 2. Cylinder 21 is incorporated with a piston rod 22. More specifically, the periphery of a sliding part 22*a* of piston rod 22 slides inside a cylinder part 21 a of cylinder 21 and the periphery of a pin part 22*b* of piston rod 22 slides inside a flange part 21*b* of cylinder 21. Each slideway includes a gasket to prevent leakage of pressurized oil. The top of a sliding part 22*b* of piston rod 22 is affixed by bolts 24 to bolster 4 via a plate 23.

A rod part 22*c* of piston rod 22 slides inside a hole in a cylinder bottom part 21*c*. The sliding part of rod part 22*c* is sealed with a gasket (not shown). The lower end of the rod part 22*c* is threaded so that it can engage a nut 25. Cylinder 21 includes two joints 26 and 27. A hydraulic circuit consisting of a hydraulic pump, solenoid valves, etc., is connected to joints 26 and 27. The hydraulic circuit feeds pressurized oil to cylinder 21 via joints 26 and 27 as the solenoid valves are switched appropriately. When the pressurized oil is fed via joint 26, the pressurized oil flows into an oil chamber 29 formed by the top of sliding part 22*a* and the bottom of flange 21*b*. When the pressurized oil is fed via joint 27, the pressurized oil flows into an oil chamber 28 formed by the bottom of sliding part 22*a* and the top of cylinder bottom part 21*c*. In this manner, piston rod 22 is raised or lowered.

The left side of the centerline on FIG. 3 shows a normal status press operation status, while the right side shows the die opening status die maintenance/inspection status. That is, the left side of the centerline shows the status when the bolster is at its upper limit, while the right side shows the status when the bolster is at its lower limit.

In the normal status shown on the left side of the centerline on FIG. 3, the pressurized oil flows into lower oil chamber 28 via joint 27. The oil pressure is maintained by conventional gaskets, and a check valve, etc., (not shown). With oil pressure maintained in this way, the press load generated in the press operation is borne by the hydraulic force of the four hydraulic cylinders 20.

The upper limit of piston rod 22, (i.e., the upper limit of bolster 4) is limited when nut 25 abuts a portion of bed 2. Therefore, the elevation stroke of bolster 4 can be adjusted by adjusting the position of nut 25 appropriately. The embodiment allows the die height to be adjusted as well. Consequently, the position of bolster 4 and its parallelism with slide 1 can be always maintained each time bolster 4 is raised and lowered.

On the other hand, the parallelism of bolster 4 can be adjusted by inserting one or more of several plates 23 of different thicknesses. For more accurate adjustment, shims (not shown) may be inserted between the bottom of bolster 4 and the top of plate 23.

When the die is opened as shown on the right side of the centerline on FIG. 3, the pressurized oil in oil chamber 28 is vented and the pressurized oil flows into oil chamber 29 via joint 26. The pressure of the oil in this case does not need to be high since its purpose is simply to lower bolster 4. The lowering of bolster 4 is aided by its own weight. The lower limit of bolster 4 is established when the bottom of bolster 4 abuts the top of flange part 21*b* of cylinder 21 as shown on FIG. 3. At this stage, the space between the bottom of the slide and the top of the bolster is wide open. This condition permits easy access for die maintenance or inspection even on a high speed automatic press whose slide stroke is in the range of between a few millimeters to slightly more than 10 millimeters.

Moreover, as it transfers from the state shown on the left side to the right side of FIG. 3 or vice versa, the vertical motion of bolster 4 is guided by guideposts 10. The slide 1 is kept at the top dead center during die maintenance or inspection. As can be seen from the above, the vertical stroke guide of slide 1 and the elevation of bolster 4 share the common means, the horizontal alignment between the upper and lower dies remains undisturbed before and after maintenance or inspection.

Having described preferred embodiments of the present invention with reference to the accompanying drawings, it is to be understood that the invention is not limited to those items customarily implemented on presses. Moreover, although it is preferable that the present invention be applied to high-speed automatic presses, but the present invention can produce identical advantages when it is applied to other presses especially on presses with short slide strokes using similar constitutions.

Although only a single or few exemplary embodiments of the present invention have been described in detail above, those skilled in the art will readily appreciate that many modifications are possible in the exemplary embodiments without materially departing from the novel teachings and advantages of this invention. Accordingly, all such modifications area intended to be included within the scope of this invention as defined in the following claims. In the claims, means-plus-function clauses are intended to cover the structures described herein as performing the recited function and not only structural equivalents but also equivalent structures.

What is claimed is:

1. A bolster-elevating device for a press, of a type having a bolster, an upper surface of which a lower die may be affixed, and a slide to a lower surface of which an upper die may be affixed, said press being capable of performing stamping operations by vertical motion of said slide and upper die with respect to said lower die, comprising:

bolster-elevating drive means for raising and lowering said bolster;

guide means for guiding vertical strokes of said slide and for guiding said bolster during raising and lowering thereof; and a stroke of said bolster-elevating drive means being sufficiently large for forming a space between said upper die and said lower die to permit performing maintenance and inspection of said upper and said lower dies.

2. A bolster-elevating device for a press according to claim 1 wherein said guide means includes:

a plurality of pin members extending downward from a bottom surface of said slide; and guide members on a top surface of said bolster in correspondence with said pin member, wherein said guide means serves as a common guide means for said slide and said bolster.

3. A bolster-elevating device for a press according to claim 1 wherein said bolster-elevating drive means includes at least one hydraulic cylinder.

4. A bolster-elevating device for a press according to claim 2 wherein said bolster-elevating drive means includes at least one hydraulic cylinder.

5. A bolster-elevating device for a press according to claim 3 wherein said hydraulic cylinder device includes:

a rod affixed to a piston of said hydraulic cylinder;

an abutment member on a distal end of said rod; and means for abutting said abutment member to limit an upper limit position of said piston.

6. A bolster-elevating device for a press according to claim 4 wherein said hydraulic cylinder device includes:

a rod affixed to a piston of said hydraulic cylinder;

an abutment member on a distal end of said rod; and means for butting said abutment member to limit an upper limit position of said piston.

7. A bolster-elevating device according to claim 1, further comprising:

said bolster-elevating drive means comprising a hydraulic cylinder affixed below said bolster;

said hydraulic cylinder trapping pressurized fluid therein during operation of said press, whereby bolster support is provided by said hydraulic cylinder; and said hydraulic cylinder at least releasing said pressurized fluid to permit lowering of said bolster.

* * * * *